US010328477B2

(12) United States Patent
Adams et al.

(10) Patent No.: US 10,328,477 B2
(45) Date of Patent: Jun. 25, 2019

(54) SYSTEM AND METHOD FOR FORMING A METAL BEVERAGE CONTAINER USING PRESSURE MOLDING

(71) Applicant: The Coca-Cola Company, Atlanta, GA (US)

(72) Inventors: John Adams, Alpharetta, GA (US); Rajesh Gopalaswamy, Alpharetta, GA (US); Karina Espinel, Montebello, NY (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 13/731,469

(22) Filed: Dec. 31, 2012

(65) Prior Publication Data

US 2013/0167607 A1 Jul. 4, 2013

Related U.S. Application Data

(60) Provisional application No. 61/586,995, filed on Jan. 16, 2012, provisional application No. 61/586,990, filed on Jan. 16, 2012, provisional application No. 61/581,860, filed on Dec. 30, 2011.

(51) Int. Cl.

| | |
|---|---|
| ***B21D 26/049*** | (2011.01) |
| ***B21D 26/041*** | (2011.01) |
| ***B21D 51/26*** | (2006.01) |
| ***B21D 26/047*** | (2011.01) |
| ***B21D 51/16*** | (2006.01) |

(52) U.S. Cl.

CPC ..... *B21D 26/041* (2013.01); *B21D 26/047* (2013.01); *B21D 26/049* (2013.01); *B21D 51/16* (2013.01); *B21D 51/26* (2013.01); *B21D 51/2669* (2013.01); *Y10T 29/49986* (2015.01)

(58) Field of Classification Search

CPC .. B21D 26/049; B21D 26/033; B21D 26/055; B21D 51/16; B21D 51/24; B21D 51/26; B21D 51/2692; B21D 51/2669; B21D 26/047; Y10T 29/49986

USPC ..... 72/61, 62, 54, 58, 370.22; 29/527.4

See application file for complete search history.

(56) References Cited

U.S. PATENT DOCUMENTS

| | | | |
|---|---|---|---|
| 3,892,829 | A | 7/1975 | Uhlig |
| 3,896,648 | A | 7/1975 | Schertenleib |
| 4,304,350 | A | 12/1981 | Paez et al. |

(Continued)

FOREIGN PATENT DOCUMENTS

| | | | |
|---|---|---|---|
| WO | 2004/039511 | A1 | 5/2004 |
| WO | WO2004/039511 | A1 | 5/2004 |

OTHER PUBLICATIONS

International Search Report of PCT/US2012/072325 dated Apr. 22, 2013, pp. 2.

Patentability Search Report dated Dec. 18, 2012.

*Primary Examiner* — Peter Dungba Vo
*Assistant Examiner* — Joshua D Anderson

(57) ABSTRACT

A system and method of manufacturing a metal vessel may include inserting a preform into a mold that includes multiple segments, the preform being a work hardened metal. A pre-pressure may be applied to the preform at a first pressure level. The multiple segments of the mold may be closed, and the pressure being applied to the preform may be increased using a step function to a second pressure level after the mold is closed to cause the preform to take a shape defined by the mold.

20 Claims, 5 Drawing Sheets

(56) References Cited

U.S. PATENT DOCUMENTS

| | | | | |
|---|---|---|---|---|
| 5,187,962 | A | 2/1993 | Bilko et al. | |
| 5,746,080 | A | 5/1998 | Hartman et al. | |
| 5,970,767 | A * | 10/1999 | Hartman | B21D 51/2646 72/58 |
| 6,067,831 | A | 5/2000 | Amborn et al. | |
| 6,250,122 | B1 * | 6/2001 | Robinson | B21D 26/049 29/421.1 |
| 6,272,849 | B1 | 8/2001 | Hudson et al. | |
| 6,272,894 | B1 | 8/2001 | Hudson et al. | |
| 6,349,583 | B1 | 2/2002 | Kleinschmidt et al. | |
| 6,577,919 | B1 | 6/2003 | Tomonaga et al. | |
| 6,802,196 | B2 | 10/2004 | Gong et al. | |
| 6,834,522 | B2 | 12/2004 | Leppin et al. | |
| 7,107,804 | B2 | 9/2006 | Gong et al. | |
| 7,188,499 | B2 * | 3/2007 | Ogaki | B21D 26/049 72/102 |
| 7,191,032 | B2 * | 3/2007 | MacEwen | B21D 26/033 220/562 |
| 7,726,162 | B2 * | 6/2010 | Druesne | B21D 26/049 29/421.1 |
| 7,757,527 | B2 | 7/2010 | Kubacki et al. | |
| 2002/0162371 | A1 | 11/2002 | Hamstra et al. | |
| 2003/0084694 | A1 | 5/2003 | Gong et al. | |
| 2011/0113732 | A1 | 5/2011 | Adams et al. | |
| 2011/0167886 | A1 | 7/2011 | Mallory et al. | |

* cited by examiner

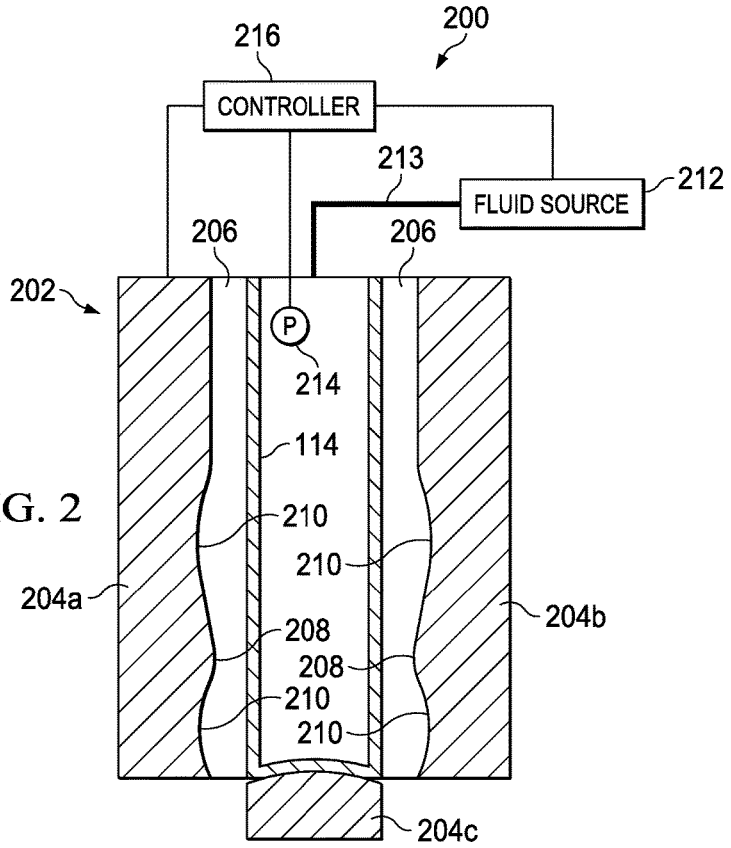
FIG. 2
FIG. 3
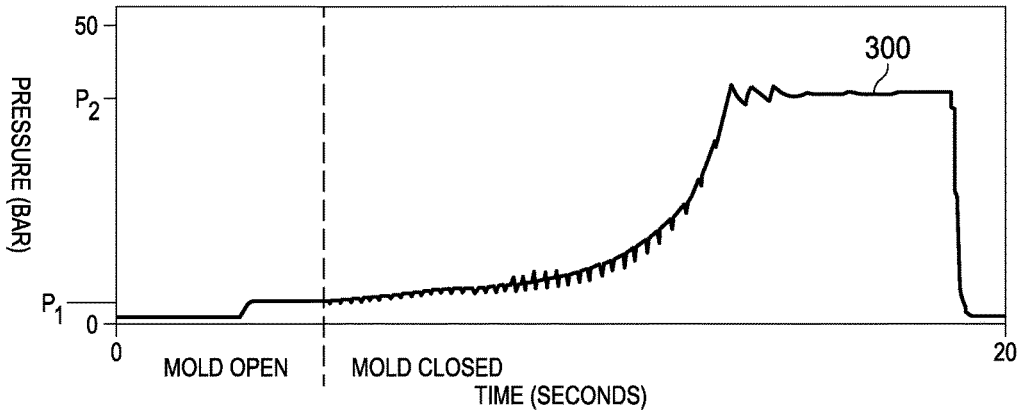

SYSTEM AND METHOD FOR FORMING A METAL BEVERAGE CONTAINER USING PRESSURE MOLDING

RELATED APPLICATIONS

This application claims priority to U.S. Provisional Patent Applications 61/581,860 filed Dec. 30, 2011 entitled System and Method for Forming a Metal Beverage Container; 61/586,995 filed Jan. 16, 2012 entitled Metal Beverage Container Preform, and 61/586,990 filed Jan. 16, 2012 entitled Blow Forming of Heated Preform; the contents of which are hereby incorporated by reference in their entirety.

TECHNICAL FIELD

This disclosure relates to the manufacturing of metal beverage containers.

BACKGROUND

Metal containers can be used to store beverages. Typical cans having a one-piece drawn and ironed body or a body open at both ends with a separate closure member at the top and bottom generally have simple upright cylindrical side walls. It can be desirable to form the side walls into different and/or more complex shapes for reasons related to aesthetics and/or product identification. For example, it can be desirable to shape a can so as to resemble a glass bottle.

A metal preform ("preform") can be made from a metal sheet (e.g., aluminum sheet, aluminum-based alloys, steel, etc.) having, for example, a recrystallized or recovered microstructure and with a gauge in the range of about 0.004 inches to about 0.015 inches. Thinner and thicker gauges are also possible, such as between about 0.002 inches and about 0.020 inches. The preform can be a closed-end tube made by, for example, a draw-redraw process or by back-extrusion. The diameter of the preform can (but need not) lie somewhere between the minimum and maximum diameters of the desired container product. Threads can be formed on the preform prior to subsequent forming operations. The profile of the closed end of the preform can be designed to assist with the forming of the bottom profile of the final product.

Because vessels, such as those in the shape of a bottle, have certain axial strength criteria to prevent damage to the bottle during the life-cycle of the bottle, including filling, packaging, shipping, shelving, and consumer usage, materials used for the vessels are limited. Materials that are too soft are unsuitable due to the axial strength criteria. Additionally, material that is too thick, which would help to improve axial strength, is unsuitable due to weight and cost limitations for producing and shipping consumer products. Heating certain metals can degrade strength and structure of the final product, so metal selection and heating processes may be limited for producing metal vessels in the shape of glass bottles or otherwise, as well.

SUMMARY

In performing pressure molding, a system for shaping a metal tubular preform may include a segmented mold configured to form a cavity when closed and at least one controller. The controller(s) can cause the preform to be pressurized such that as the segmented mold closes around the preform to form the cavity and at least partially shape the preform (i.e., inward extending projections of the mold may contact the preform while closing), deformation of the preform resulting in shape defects of the preform is minimized. The controller(s) can also cause the segmented mold to close around the preform such that the preform is disposed within the cavity, and can cause a step increase in the pressure within the preform to expand portions of the preform into the cavity. The controller(s) can further cause the preform to be pressurized with a first fluid. A step increase in the pressure within the preform can be used to expand portions of the preform into the cavity, and may include delivering a second fluid into the preform. The first fluid and second fluid may be different. For example, the first fluid can be a gas and the second fluid can be a liquid. Alternatively, the first fluid can be a liquid and the second fluid can be a liquid. The preform may be unheated during the pressure molding process.

In performing pressure molding, a method for shaping a metal tubular preform may include delivering a gas into the metal tubular preform to cause the preform to be pre-pressurized such that as a segmented mold closes around the preform to form a cavity and at least partially shape the preform, deformation of the preform resulting in a shape of the preform that is not the complement of the cavity is inhibited. The method may further include closing a segmented mold around the pre-pressurized preform such that the preform is disposed within the cavity and delivering a liquid into the preform to cause an increase in the pressure within the preform to expand portions of the preform into the cavity. The liquid can be delivered into the preform to cause a step increase in the pressure within the preform. The preform may be unheated during the pressure molding process. The segmented mold can include projecting portions that cause the preform to deform as the segmented mold closes around the preform, as previously described.

In performing blow molding, a method for manufacturing a metal beverage container may include arranging a metal preform, having metal sidewalls and a dome shaped metal bottom or closed end portion configured to withstand, for example, a pressure of at least 90 pounds per square inch without plastically deforming, adjacent to a heat source (i) such that heat from the heat source is transferred to the metal sidewalls to sufficiently soften the metal sidewalls to permit radial expansion of the metal sidewalls when subjected to fluid pressure of at least 30 bar and (ii) such that heat within the metal sidewalls sufficiently dissipates prior to conducting to the dome shaped metal bottom portion so as to prevent compromising the ability for the dome shaped metal bottom portion to withstand a pressure of at least 90 pounds per square inch without plastically deforming. The blow molding method may also include pressurizing the metal preform to radially expand the sidewalls by, for example, at least 15%.

One embodiment of a system and method of manufacturing a metal vessel may include inserting a preform into a mold that includes multiple segments, the preform being a work hardened metal. A pre-pressure may be applied to the preform at a first pressure level. The multiple segments of the mold may be closed, and the pressure being applied to the preform may be increased using a step function to a second pressure level after the mold is closed. The increase of the pressure from the first pressure level to the second pressure level causes the preform to take a shape defined by the mold. The molded preform may be removed from the mold.

One embodiment of a method and system of manufacturing a metal vessel may include providing a preform being a work hardened metal. The preform includes an open portion, a closed end portion, and body portion. The body portion of the preform may be preheated in a manner that limits heat being applied to the open portion and closed end portion of the preform. The preheated preform may be inserted into a mold that includes multiple segments, and the multiple segments of the mold may be closed. The preform may be blow molded to cause the preform to take a shape defined by the mold, and the mold preform may be removed from the mold.

BRIEF DESCRIPTION OF THE DRAWINGS

Illustrative embodiments of the present invention are described in detail below with reference to the attached drawing figures, which are incorporated by reference herein and wherein:

FIG. 2 is a side view, in cross-section, of a segmented mold (open) and preform before fluid forming along with a controller and fluid source utilized in producing a shaped metal vessel;

FIG. 3 is a plot of internal preform pressure generated by a piston pump oil system;

DETAILED DESCRIPTION

Pressure Molding Process

Figure 1:
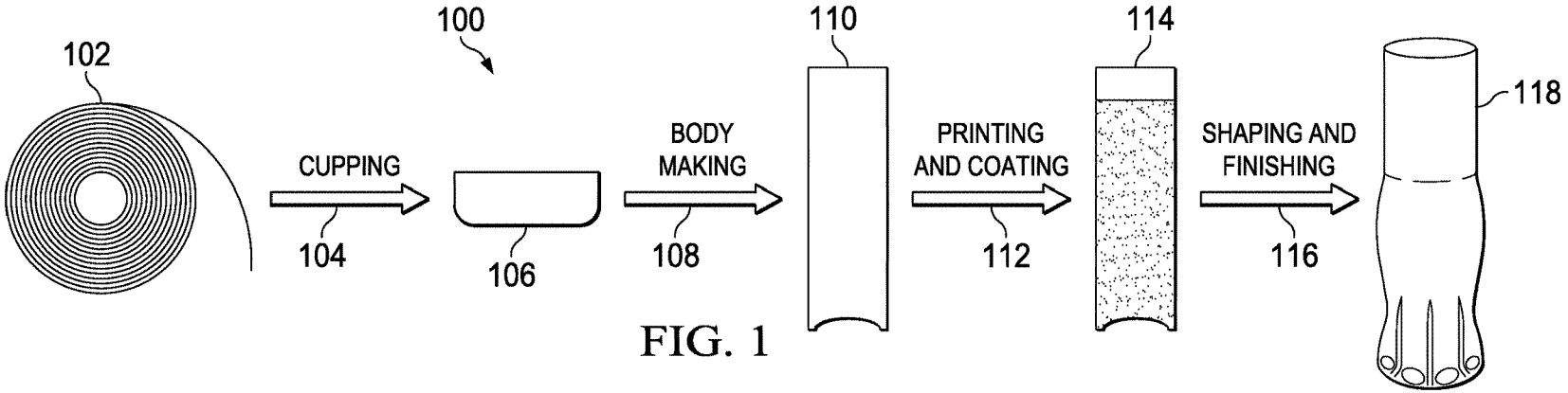
FIG. 1 is a schematic diagram illustrating operations for forming a metal beverage container.

Referring to FIG. 1, a metal coil 102 may be processed by a cupping operation 104 to shape a portion of the metal coil 102 into a cup 106, as understood in the art. The cup 106 can be processed by a body making operation 108, as understood in the art, to be shaped into a bare cylinder or tube 110 (metal preform or preform). The bare cylinder 114 can undergo known/suitable printing and coating operations at step 112 to yield a coated cylinder 114 (coated preform). As explained in more detail below, the coated preform 114 (or preform 110) can by shaped by shaping and finishing (or crushing and fluid forming) operations at step 116 to form portions of a metal beverage container 118 resembling, for example, a glass bottle. The processes described in FIG. 1 have been used for a variety of different production uses. However, as a result of having to use certain materials for producing shaped metal vessels (e.g., glass bottle shaped vessel) that meet certain design criteria (e.g., axial strength threshold), the shaping and finishing process 116, among other processes, may use non-conventional techniques, as further described herein, to produce those shaped metal vessels.

Referring to FIG. 2, an illustrative molding system 200 includes a mold 202 formed from side segments 204*a* and 204*b*, and bottom segment 204*c* (collectively 204), is configured to form a cavity 206 defining a complement of the shape of the bottom portion of the metal beverage container 118 (FIG. 1). The mold 202, in other embodiments, can have any desired number of segments. In the embodiment of FIG. 2, the cavity 206 formed by the side segments 204*a* and 204*b* (when closed) defines the complement of the shape of "flutes" or "ribs" found, for example, on the bottom portion of glass beverage containers sold by The Coca-Cola Company. Other configurations are also possible.

In one embodiment, projecting or projection portions 208 of the cavity 206 project into/impinge on the preform 114 when the segments 204*a* and 204*b* close around the preform 114 to form the cavity 206. The projecting portions 208 partially deform/shape the preform 114. Recessed portions 210 of the cavity 206 do not project/impinge on the preform 114 when the segments 204*a* and 204*b* close around the preform 114 to form the cavity 206. Fluid forming techniques (e.g., hydro forming, etc.) can be used to expand/deform the preform 114 into the recessed portions 210 of the cavity 206.

Testing has revealed that if the pressure within the preform 114 is sufficiently low (e.g., less than 3 bar), shape defects in the preform 114 can result when the segments 204*a* and 204*b* close to form the cavity 206. This threshold pressure depends on the gauge of the preform 114, the diameter of the preform 114, the material comprising the preform 114, etc., and can be determined via testing, simulation, etc. That is, deformation, crushing, or wrinkling that is not consistent with the complement of the shape defined by the cavity 206 can occur as the projecting portions 208 impinge on the preform 114. To minimize or preclude these shape defects, the preform 114 can be pre-pressurized. It should be understood that the diameter of the preform 114 may be larger than then diameter of the mold 202 when in the closed position as a result of the material of the preform 114 having limited elasticity (e.g., work hardened aluminum, such as 3000 series aluminum) and having a thin gauge (e.g., between approximately 0.004 inches and approximately 0.020 inches) as the preform 114 has limited expansion capability as compared to other metals that are more elastic, such as superplastic metals and alloys. Alternative configurations of the preform 114 may be utilized where the diameter of the preform 114 is less than the diameter of the mold 202 in a closed position, which may allow for the mold to not contact the preform while closing. Metals that may be utilized in accordance with the principles of the present invention may include beverage can alloys and bulk aluminum, as understood in the art. The type of metal, mold configuration, molding technique, etc., determines whether the mold will contact the preform when closing. That is, if the metal of the preform is a relatively non-plastic metal, then the amount of stretch that is possible with the metal is limited, and, therefore, the mold is to be closer to the preform, including contacting the preform while closing so that the preform may contact all portions of the mold during the molding operation.

Referring to FIG. 3, an illustrative pressure waveform 300 generated by a piston pump oil system is shown to illustrate a pressure waveform that may provide insufficient or unacceptable results in producing a shaped metal vessel for use in accordance with the principles of the present invention. As provided, a preform can be pressurized prior to closing a segmented mold around the preform. The pressure to which the preform is first pressurized should be sufficient to minimize or preclude the shape defects described above. In the embodiment of FIG. 3, this first pressure threshold (pre-pressurization threshold) is 5 bar. Other thresholds, however, can be used depending on preform gauge, preform diameter, preform material, etc. Any suitable fluid (e.g., water, oil, air) can be used to pre-pressurize the preform. In one embodiment, the pre-pressure uses air as liquid is non-compressible. That is, the use of liquid, such as water, may be used for creating higher pressures (e.g., about 40 bar or higher) in a fast motion, as further described herein (see FIGS. 4 and 5).

Once a segmented mold has closed around the preform, the pressure within the preform can be increased via the introduction of fluid (e.g., water, oil, air) to a second pressure threshold (final pressurization threshold) to fluid form the preform into recessed portions of the cavity. This second pressure threshold is approximately 40 bar in the embodiment of FIG. 3. Other thresholds, however, can be used (e.g., 35-160 bar) depending on preform gauge, preform diameter, preform material, fluid used to pressurize the preform, etc. It should be understood that more plastic metals or other materials, including superplastic aluminum or alloys, tend to use lower pressure with comparable gauge due to being more pliable. However, such materials tend to not achieve sufficient strength, at least axial strength, for use in consumer beverage products. In one embodiment, the pressurization is made at room temperature (i.e., without a heat source applying heat to the preform prior to or during the molding process. Once forming is complete, the fluid(s) within the preform can be evacuated, and the preform can be further processed as desired.

Testing has also revealed that the rate at which the pressure within the preform is increased from the first pressurization level to the final pressurization level can fatigue the preform in an undesirable manner. As apparent from FIG. 3, second order pulsing of the pressure waveform 300 is observed during the approximate 10 second increase to the final pressurization threshold (i.e., pulsing pattern shown on the pressure waveform 300 starting from the time that the mold closes to the maximum pressure). This pulsing results from the manner in which the compressor (for gas) or accumulator (for liquid) operates to increase the preform pressure and results in cyclic loading of the preform, which can fatigue the metal of the preform. A relatively slow rate of pressure increase causes the compressor, for example, to experience mini-cycles of increasing and decreasing pressure as the compressor operates to increase the pressure within the preform. It should be understood that a slower pressure rise may be used for materials with alternative parameters (e.g., higher plastic, thicker gauge, etc.) than those being utilized in accordance with the principles of the present invention. As explained below with regard to FIGS. 4 and 5, the pulsing of the pressure waveform 300 can be reduced by reducing the time for the pressure rise.

Figure 4:
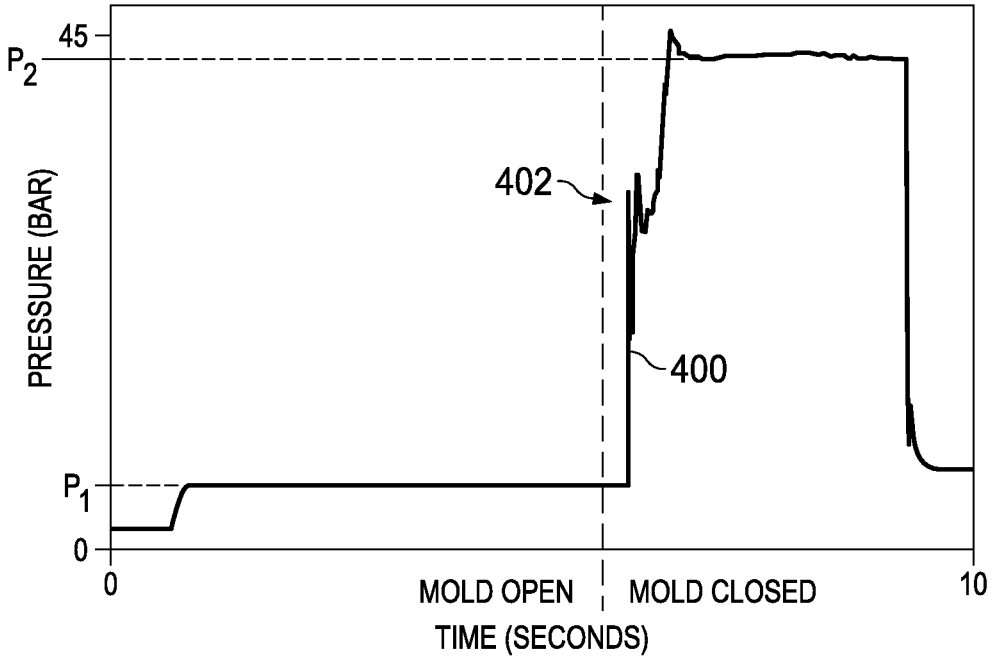
FIG. 4 is a plot of internal preform pressure generated by an oil accumulator system.
Figure 5:
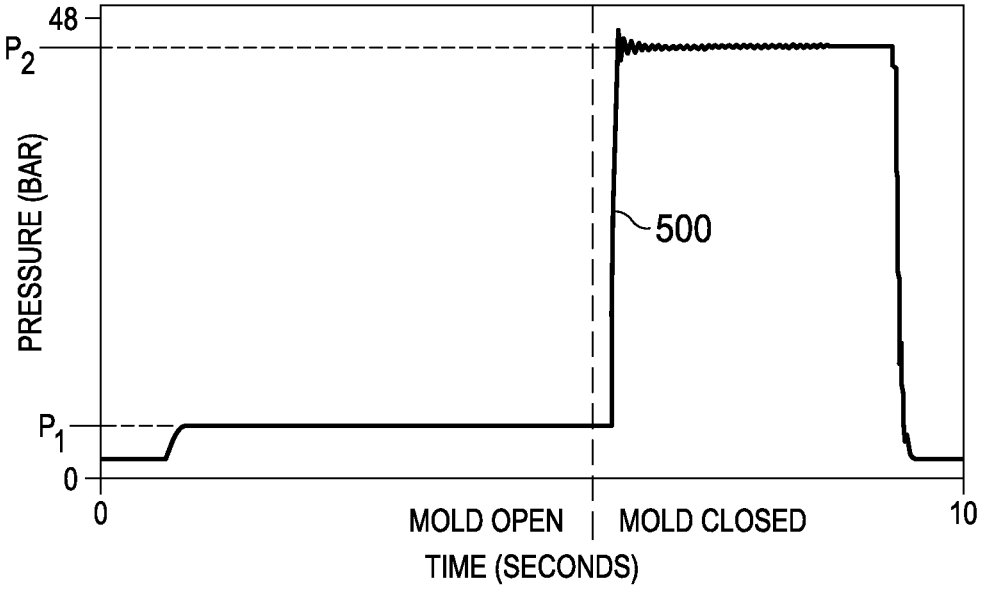
FIG. 5 is a plot of internal preform pressure generated by an air compressor system for producing a metal vessel in accordance with the principles of the present invention.

Referring to FIGS. 4 and 5, illustrative pressure waveforms 400 and 500 produced through use of an oil accumulator system and air compressor system, respectively, provide for two alternative pressure profiles that may be applied to a preform for producing a shaped metal vessel. As shown, the time during which the pressure is increased from the first pressurization level ($P_1$) to the final pressurization level ($P_2$) has been reduced. The accumulator and compressor systems of FIGS. 4 and 5, respectively, facilitate a step-like change in pressure during a relatively short time interval (e.g., approximately 0.2 seconds or less) to minimize pulsing and, hence, preform fatigue. The reduced fatigue results from limiting the ability of the metal at the gauge, elasticity, temperature, etc. of the preform to react to prevent expansion through a short pressure transition. As shown in FIG. 4, the pressure waveform 400 stops at an intermediate pressure level 402 while transitioning between the first and second pressure levels $P_1$ and $P_2$ as a result of not being transitioned fast enough between the first and second pressure levels $P_1$ and $P_2$. As a result of hesitating at the intermediate pressure level 402, metal vessels that are formed by the pressure waveform 400 may result in having imperfections (e.g., tears or wrinkling).

As shown in FIG. 5, the pressure waveform 500 transitions between the first and second pressure levels $P_1$ and $P_2$ sufficiently fast (e.g., less than about 0.2 seconds or significantly less than 0.2 seconds). This rapid increase in pressure does not allow the accumulator and compressor systems to experience the mini-cycles described above. Any suitable pressurization time period (e.g., 0.1-1 seconds), however, that is fast enough to prevent damage to the metal vessel may be used. As described above, the top pressure may be 40 bar or higher for a strong metal, such as work hardened aluminum. In one embodiment, the work hardened aluminum may be a 3000 aluminum series, such as 3104 aluminum alloy. A surprising result that the metal preform was not damaged as a result of the fast pressure transition from a low to a high pressure at room temperature was found. It was discovered that the fast pressure transition in the form of a step, as described above, at room temperature has the best results in terms of not damaging the preform as the work hardened aluminum at the gauges being utilized for the preform does not have an opportunity to react to the pressure transition, thereby minimizing discontinuities or uneven expansion of the material of the preform.

Referring again to FIG. 2, a fluid source 212 is arranged to be in fluid communication with the preform 114 prior to the segments 204*a* and 204*b* closing. The fluid source 212 can be configured to provide gaseous (e.g., air, etc.) and/or liquid (e.g., water, oil, etc.) fluids to the preform 114. In the embodiment of FIG. 2, the fluid source 212 includes an air tank and a water tank arranged through appropriate valving and piping to provide air and/or water to the preform 114. The preform 114 is, of course, sealed in any known/suitable fashion so that it can hold pressure. Other arrangements, however, are also possible.

A pressure sensor 214 can be arranged within the preform 114 or within the valving and piping fluidly connecting the preform 114 and fluid source 212 to detect pressure within the preform 114. As a result of including the pressure sensor 214, an operator and/or controller 216 may monitor pressure being applied to the preform 114 prior to, during, and after performing a molding operation to the preform 114.

The mold 202, fluid source 212 (tanks, valving, piping, conduit(s), etc.), and pressure sensor 214 can be in communication with/under the control of one or more controllers 216 (collectively "controller"). The controller 216 may be configured to control the opening/closing of the mold 202 and the delivery of fluid to the preform 114 via a conduit 213. The conduit 213 may be a tube or other hollow member that allows for fluid to flow between the fluid source 212 and the cavity 206 of the mold 202. With the preform 114 suitably positioned on the segment 204*c* and between the open segments 204*a* and 204*b*, the controller 216 can cause the fluid source 212 to provide, for example, to create a pre-pressurization by supplying air, for example, to the preform 114 until an internal pressure of the preform 114 achieves a pre-pressurization, such as approximately 5 bar. In one embodiment, the controller 216 may control the fluid source 212 to create or otherwise release fluid to cause pressure to increase at the preform 114. Alternatively, the controller may cause one or more valves (not shown) attached to the conduit 213 to be adjusted (e.g., open, close, or partially open/close) to release fluid to cause pressure to increase at the preform 114. In causing the pressure to be increased at the preform 114, the controller 216 may be configured to communicate electrical signals to cause an electromechanical device, such as a valve, to be adjusted, as understood in the art.

Figure 6:
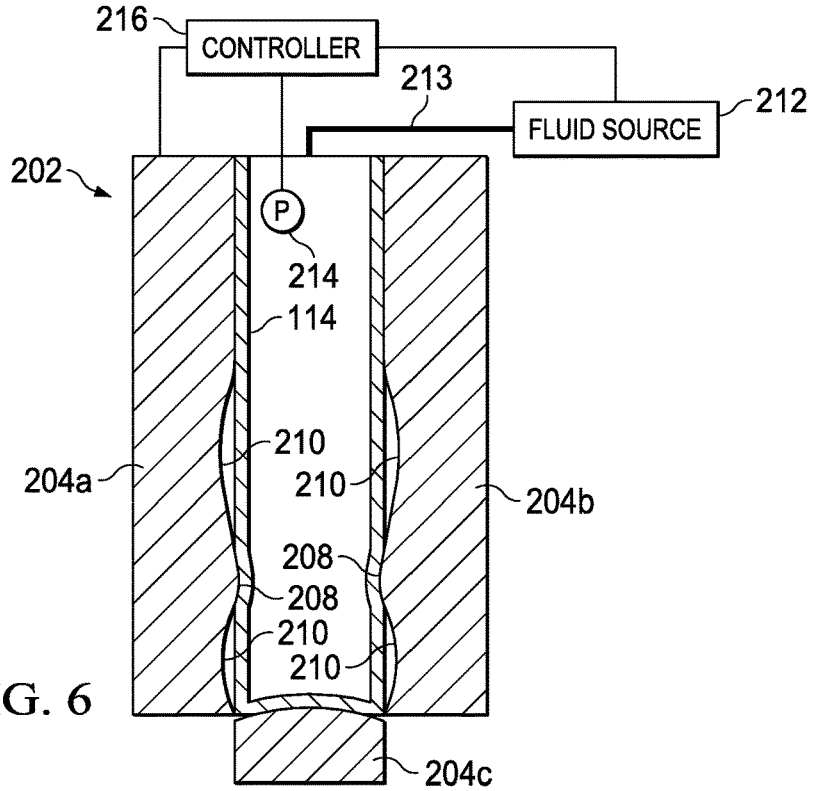
FIG. 6 is a side view, in cross-section, of the segmented mold (closed) and preform of FIG. 2 before expansion.

Referring to FIG. 6, the controller(s) 216 can cause the segments 204*a* and 204*b* to close around the preform 114 to form the cavity 206 after the internal preform pressure achieves 5 bar, for example. As described above, this internal pressure minimizes/precludes shape defects of the preform as the projecting portions 208 deform the preform.

Figure 7:
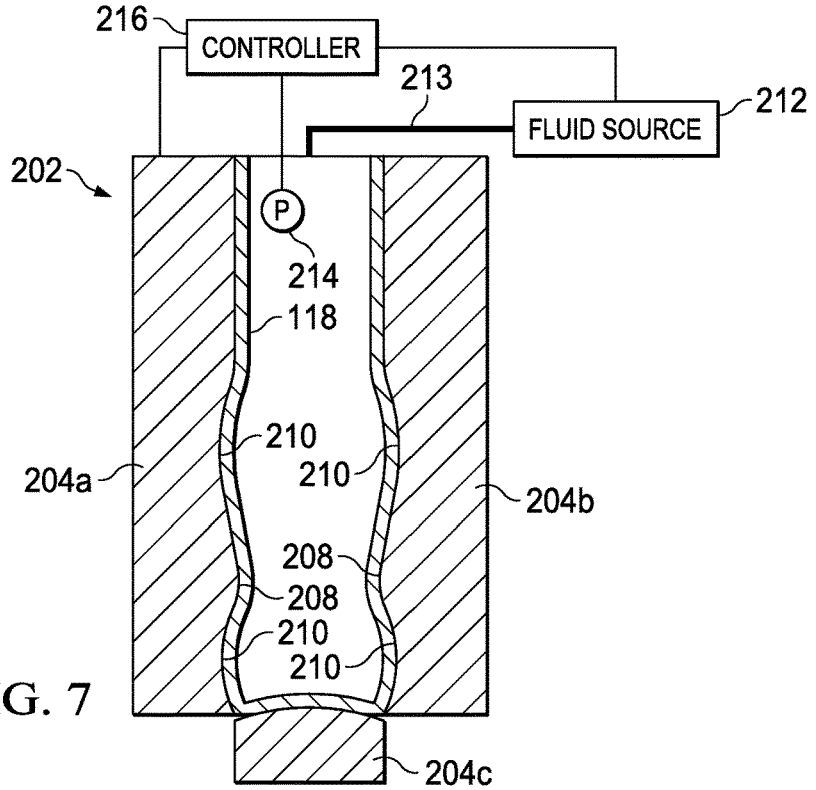
FIG. 7 is a side view, in cross-section, of the segmented mold (closed) and preform of FIG. 2 after expansion.

Referring to FIG. 7, the controllers 216 can cause the fluid source 212 to provide, for example, water or oil to the preform until the internal pressure of the preform achieves approximately 40 bar in a manner similar to that described with reference to FIGS. 4 and 5. This forming operation, in the example of FIG. 7, expands the preform into the recessed portions 210 of the cavity 206. Once the shaping of the preform 114 is complete, the controllers 216 can cause the fluid(s) therein to be evacuated so that the shaped preform 118 can be further processed as desired. Although liquid, such as oil or water, may be utilized to generate the pressure, air or other gas may be utilized to create the pressure, thereby eliminating cleaning and/or drying steps.

The preform illustrated in FIGS. 2, 6 and 7 is unheated. That is, a heating operation need not be performed prior to the segments 204*a* and 204*b* closing or during fluid forming. Depending on the material of the preform, as previously described, preheating may cause the preform to weaken, thereby causing damage to the preform during the shaping process or thereafter. As provided in FIG. 1, the preform 110 may have printing and coatings applied thereto in creating the preform 114. Heating of preforms prior to or during the shaping process 116 are generally at temperatures of 200 degrees Celsius or higher for metals, such as superplastic metals. In addition to weakening the preform 114, such temperatures may cause damage to the printing and/or coating of the preform 114. So, by performing the shaping and finishing process 116 at room temperature, damage to the printing and/or coating of the preform 114 may be prevented and the preform may remain as strong as possible. In an alternative embodiment, it may be possible for preheat the preform at temperatures below 200 degrees Celsius that do not weaken the metal or negatively impact coatings or printing on the preform.

Blow Molding Process

Blow molding techniques can be used to form metal into, for example, the shape of a glass bottle. A blow molding apparatus can be loaded with a metal preform, e.g., a cylinder having an open end and a closed end. Fluid under pressure can then be delivered to the interior of the preform via the open end to expand the preform into a surrounding mold. The maximum radial expansion of the preform in such circumstances is in the range of 8% to 9% for 3000 series aluminum, for example. It has been found, however, that a work hardened preform with certain gauges as previously described has the ability to expand upwards of 20% at room temperature. Hence, if the diameter of the finished container is to be approximately 58 millimeters, the initial diameter of the preform should be no less than approximately 53 millimeters. In cases where the preform has a diameter less than that of the smallest diameter of the mold, then a pre-pressurization may not be needed as the preform is not deformed by the mold closing. For larger expansions, such as up to 40%, selective or localized preheating may be performed to further increase expansion of the preform, as further described herein. Such increased expansion may be used in the case where the mold has portions where the preform is to extend to create a final blow molded product.

A bottle shaped metal beverage container often has a top or finish portion formed near the open end of the container. To facilitate drinking from the container, the diameter of the top portion is usually less than the initial diameter of the associated preform. The diameter of the top portion, for example, can be approximately 28 millimeters. As many as 35 to 40 die necking (or similar) operations may need to be performed to reduce the initial diameter of the preform down to the desired top finish diameter. Performing this number of operations contributes to a considerable portion of the overall container manufacturing time and limits throughput. Moreover, several (costly) die necking machines are required to support this number of operations.

It has been discovered that selectively heating portions of a metal preform prior to blow molding can increase the maximum radial expansion of the preform to 15% to 25% or more, and possibly as much as 40% or more. Hence, if the maximum diameter of the finished container is to be approximately 58 millimeters, the initial diameter of the preform can be as small as approximately 45 millimeters or smaller. This reduction in initial preform diameter can reduce the number of die necking (or similar) operations required to achieve the desired top finish diameter by as much as 50%. Fewer such operations reduce overall container manufacturing time and the number (and cost) of die necking machines required to support these operations. Moreover, a wider array of container shapes including asymmetrical container shapes is possible given the increased capability to radially expand the preform.

Figure 8:
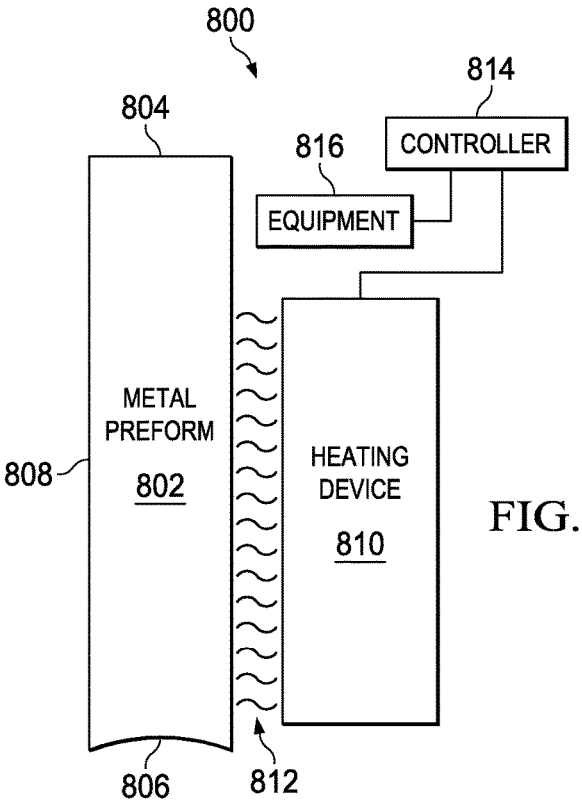
FIG. 8 is an illustration of an illustrative side view of a partially processed metal preform and heating device for use in heating a portion of the preform in accordance with the principles of the present invention.

Referring to FIG. 8, an illustrative environment 800 in which a metal preform 802 having an open end portion 804, a shaped closed end (or bottom) portion 806, and a body portion 808. The bottom portion 806 may be configured as a dome, which provides for withstanding a pressure of at least 90 pounds per square inch without plastically deforming. The body portion 808 is shown to be positioned near a heating device 810, which may be a heating element, heat lamp, hot air gun, or any other heat source. The preform 802 may pass near the heating device 810 prior to a blow molding process to cause heat 812 from the heating device 810 to soften the body portion 808. In one embodiment, ducting or other manifold configuration (not shown) may be utilized to direct heat from the heating device 810 to the body portion 808 and away from the open end and bottom portions 804 and 806 of the preform 802. In one embodiment, a blowing device (not shown), such as a fan, may be utilized to cause the heat 812 to be directed to the preform 802. As shown, the preform 802 is positioned relative to the heating device 810 such that the open and closed end portions 804 and 806 are not subjected to the same amount of direct heat as the body portion 808 of the preform 802. Because the open end portion 804 eventually forms a top portion of a bottle shaped vessel with a reduced diameter, there is no need to intentionally heat this section as it will not be subjected to blow molding, and, therefore, not have a need to be softer for stretching purposes. Because heating can soften the preform metal and thus reduce its strength, intentional heating of the closed end portion 806 is avoided to minimize losses in container bottom strength. Unintentional heating of the open and closed end portions 804 and 806 can nevertheless occur due to heat conduction throughout the body portion 808 of the preform 802.

In performing the preheating of the preform 802, a controller 814 that may include one or more processors may be in communication with machinery or equipment 816. The machinery 816 may be standard equipment for use in processing and manufacturing metal cans and/or bottles, as understood in the art. However, the machinery 816 may be modified to perform the preheating, if preheating is used, to selectively preheat the preform 802 prior to the blowing process, and as further described hereinbelow with regard to step 904 of FIG. 9. In one embodiment, pre-pressuring may be applied to the mold prior to the mold closing, thereby minimizing damage to the preform if the preform has a radius larger than the smallest radius of the mold, as previously described.

The bottom strength of the closed end portion 806 is based on a combination of its final geometric design, metal thickness, and yield strength. Reductions in container bottom strength can result in undesirable bulging or deformation when subjected to pressure from a beverage stored therein. Such undesirable bulging or deformation is much less likely to occur at the body portion 808 due to the hoop strength associated with the geometry of the container walls.

It may be desirable to maintain the bottom portion's ability to withstand, for example, a pressure of at least 90 pounds per square inch without bulging or alternatively without plastically (permanently) deforming during the preform heating process. The distance between the closed end portion 806 and the heating device 810 that permits heat within the sidewalls of the body portion 808 to sufficiently dissipate prior to conducting to the dome shaped metal bottom portion 806 so as to prevent compromising its ability to withstand, for example, a pressure of at least 90 pounds per square inch without bulging or plastically deforming depends on such factors as (i) preform material and thickness, (ii) temperature of the heating device 810, (iii) target temperature for the body portion 808, and so on, and can be determined for any particular configuration via testing, simulation, etc. Additionally, cooling air (or other fluid) can be directed over the bottom portion 806 to facilitate heat dissipation.

Initial preform thickness and diameter as well as desired maximum radial expansion can influence the extent to which body portion 808 of the preform is heated. For example, a preform having an initial diameter of 45 millimeters and a 20% desired radial expansion may be blow molded at room temperature or need to be heated to a temperature, such as below 200 degrees Celsius, to allow complete expansion stretching of the preform metal during blow molding. A preform having an initial diameter of 38 millimeters and a 42% desired radial expansion may need to be heated to a higher temperature (e.g. at least 280 degrees Celsius) to allow complete expansion stretching of the preform metal during blow molding, etc. Additionally, times associated with transferring the preforms from the heating station to the blow molding station may further influence the heating strategy as the preforms may cool during this transfer. Decreases in preform temperature on the order of 100 degrees Celsius, for example, have been observed during a 6 second transfer time.

It should be understood that temperature ranges from approximately 100 degrees Celsius to approximately 250 degrees Celsius may be utilized depending on the material, gauge, heat time, and so forth. Desired temperatures for various portions of a given preform design as well as heating times, etc. can be determined via testing or simulation. Contrary to the pressure molding process described above that is not preheated or not preheated at temperatures of 200 degrees Celsius or higher, the preform may be coated after the blow molding process as provided in FIG. 9, thereby preventing the coating from being damaged during the heating process if the heating process is to be at least about 200 degrees Celsius. As understood in the art, applying a coating to a molded preform is possible, but is more technically challenging and costly than applying a coating to a preform prior to molding.

Figure 9:
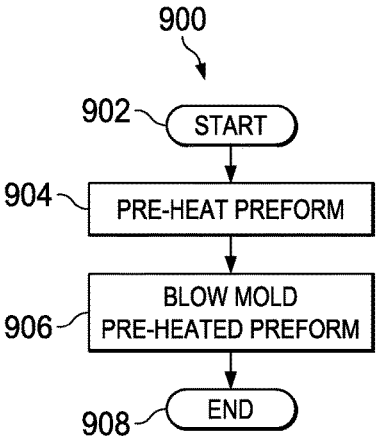
FIG. 9 is a flow diagram of an illustrative process for preheating and blow molding a metal preform.

Referring to FIG. 9, a flow diagram 900 of an illustrative process for blow molding a metallic vessel is shown. The process 900 starts at step 902, where a metal preform may be provided. The metal preform may be a work hardened metal, such as 3000 series aluminum. At step 904, the metal preform may be heated as described above (i.e., heat the body portion and not the open and closed ends of the preform) in advance of a blow molding operation at operation 906. At operation 906, the preheated preform is blow molded to form portions of the preform into a desired shape. In one embodiment, the desired shape may be the shape of a glass bottle. A pressure within the preform can be increased, for example, to 40 bar in approximately 0.5 seconds using fluid at room temperature or heated to an elevated temperature (e.g., 200-300 degrees Celsius) to expand portions of the preform into a surrounding mold. Other scenarios, of course, are contemplated. Additional processing of the molded preform can then be performed.

The process 900 may be performed using at least a partially automated process. In performing the process 900, controller 814 may be in communication with machinery 816 that causes the preform 802 to be heated by the heat 812 being generated by the heating device 810. For example, the controller 814, in communication with the machinery 814, may cause the preform 802 to pass near the heating device 810, cause the heating device 810 to pass near the preform 802, cause the heating device 810 to be applied to the preform 802, cause heat from the heating device 810 to be applied via a conduit that may be movable and/or valved (i.e., open valve applies heat, closed valve prevents heat from being applied) to the preform 802, or cause heat from the heating device 810 to be applied to the preform 802 in any other manner as understood in the art. The controller 814 may be in communication with the heating device 810 to cause the heating device 810 to generate heat. In one embodiment, the heating device 810 may be set to a specific temperature by the controller 814. Although represented that the heating device 810 is close in proximity to the metal preform 802, it should be understood that the heating device 810 may be positioned from the metal preform 802 and a conduit (not shown) extending from the heating device 810 to the preform 802, as suggested above, may be used to apply heat to the preform 802 while positioned at a station, such as at a molding station, or while being passed between stations by a conveyer, carrier, or other machinery, as understood in the art. In another embodiment, the mold itself may be configured to apply heat or have heat applied thereinto prior to and/or during the molding process.

It has further been discovered that certain initial preform geometries improve the yield of the heated blow molding process described above. That is, containers formed by way of heated blow forming from these preforms have fewer instances of wrinkles, tears or other defects.

Figure 10:
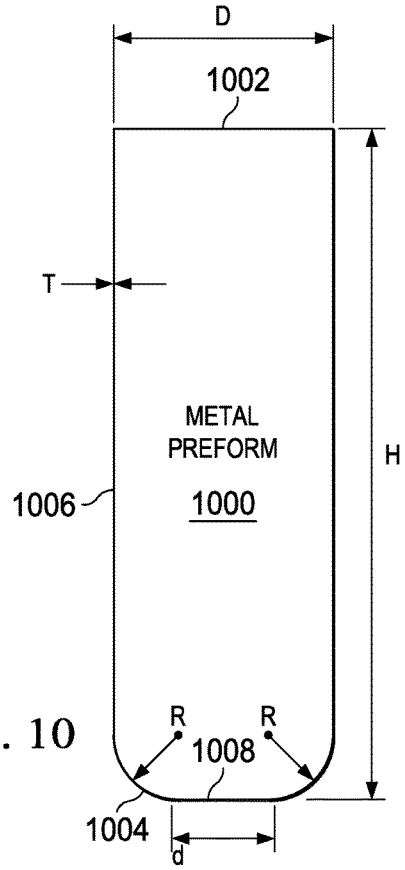
FIG. 10 is an illustration of a side view of an illustrative unprocessed metal preform.

Referring to FIG. 10, a tubular metal preform 1000 has been formed from a metal sheet having an initial thickness or gauge, for example, in the range of 0.025 inches or less. The preform 1000 has an open end portion 1002, a closed end portion 1004, and a body portion 1006. The preform 1000 further has a thickness, T, a maximum width, D, and a height, H. The thickness, T, can vary along the height, H, of the preform 1000 and have, for example, a nominal value of 0.010 inches. The closed end portion 1004 has a flat portion 1008 (to promote stability during conveyance) having a maximum width, d, and a curved portion defined by an effective radius of curvature, R, connecting the flat portion and vertical wall of the body portion 1006. In other examples, R may be a compound radius (two or more radii blended into an arc that is tangent to the flat portion and vertical wall).

Experimentation and simulation has revealed that preforms conforming to at least some of the following relationships are generally well suited to the heated blow molding operations discussed above:

$$D \leq 2R+d \quad \text{(eq. 1)}$$

$$d/D \geq 0.3 \quad \text{(eq. 2)}$$

$$H/D \geq 3 \quad \text{(eq. 3)}$$

For example, if D equals 45 millimeters and H equals 185 millimeters, then d can be 13.5 millimeters or larger, and R can be 15.75 millimeters or larger (or a compound radius can be used as desired).

While exemplary embodiments are described above, it is not intended that these embodiments describe all possible forms of the invention. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to, cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

We claim:

1. A method of manufacturing a metal vessel, said method comprising:

inserting a preform into a cavity of a mold that includes multiple segments, the cavity defining a shape of the metal vessel to be manufactured when the mold is closed, the preform being formed of a metal;

pre-pressurizing the preform by supplying a first fluid to an inside of the preform until an internal pressure of the preform achieves a desired level of pre-pressurization;

once the desired level of pre-pressurization is achieved, closing the multiple segments of the mold about the pre-pressurized preform;

after the multiple segments of the mold are closed about the pre-pressurized preform, increasing the internal pressure being applied to the inside of the pre-pressurized preform by supplying a second fluid to the inside of the pre-pressurized preform using a step function to increase the desired level of pre-pressurization to a second pressure level, causing the preform to be shaped against the cavity of the mold and take the shape defined by the cavity of the mold; and removing the molded preform from the mold.

2. The method according to claim 1, wherein pre-pressurizing the preform includes applying at least 5 bar of pressure to the inside of the preform.

3. The method according to claim 1, wherein inserting the preform into the cavity of the mold includes inserting the preform such that a radius of the preform is larger than a smallest radius of the mold, thereby causing the mold to deform the preform when the mold closes.

4. The method according to claim 1, wherein increasing the pressure includes increasing the pressure to at least 40 bar.

5. The method according to claim 4, wherein inserting the preform into the cavity of the mold includes inserting the preform at room temperature into the mold.

6. The method according to claim 4, further comprising preheating the preform below 200 degrees Celsius.

7. The method according to claim 4, wherein increasing the pressure includes increasing the pressure in less than 0.2 seconds.

8. The method according to claim 4, wherein inserting the preform into the mold includes inserting the preform with a gauge between 0.002 and 0.02 inches.

9. The method according to claim 1, wherein supplying the first fluid to the inside of the preform comprises supplying a gas to the inside of the preform.

10. The method according to claim 1, wherein supplying the second fluid to the inside of the preform comprises supplying a liquid to the inside of the preform.

11. The method according to claim 1, wherein supplying the first fluid to the inside of the preform comprises supplying a gas to the inside of the preform via a fluid source.

12. The method according to claim 1, wherein pre-pressurizing the preform includes increasing the pressure inside the preform from an atmospheric level to the desired level of pre-pressurization.

13. A method of manufacturing a metal vessel, said method comprising:

inserting a preform formed of a metal into a cavity of a mold, the cavity defining a shape of the metal vessel to be manufactured when the mold is closed;

prior to closure of the mold, pre-pressurizing the preform by supplying a first fluid to an inside of the preform until an internal pressure of the preform achieves a desired level of pre-pressurization;

closing the mold about the pre-pressurized preform; and with the mold closed, increasing the internal pressure applied to the pre-pressurized preform by supplying a second fluid to the inside of the pre-pressurized preform to create a second defined pressure level inside the pre-pressurized preform to cause the preform to be shaped against the cavity of the mold and take the shape defined by the cavity of the mold.

14. The method according to claim 13, wherein pre-pressurizing the preform includes applying at least 5 bar of pressure to the inside of the preform.

15. The method according to claim 14, wherein increasing the pressure applied to the preform includes increasing the pressure to at least 40 bar.

16. The method according to claim 13, wherein increasing the pressure occurs in less than 0.2 seconds.

17. A method of manufacturing a metal vessel, said method comprising:

inserting a metal preform into a cavity of a mold, the cavity defining a shape of the metal vessel to be manufactured when the mold is closed;

applying pressure to an inside of the preform by supplying a fluid to the inside of the preform prior to closure of the mold to create a pressurized preform;

closing the mold about the pressurized preform; and with the mold closed, varying the pressure applied to the inside of the pressurized preform by varying the supply of fluid to the inside of the preform to re-shape the preform against the cavity of the mold to cause the preform to take the shape defined by the cavity of the mold.

18. The method according to claim 17, wherein applying pressure to the inside of the preform includes introducing a first fluid into the preform.

19. The method according to claim 18, wherein varying the pressure applied to the inside of the pressurized preform includes increasing the pressure applied to the pressurized preform.

20. The method according to claim 19, wherein increasing the pressure includes introducing a second, different fluid into the pressurized preform.

* * * * *